US005507892A

United States Patent [19]

Zabala et al.

[11] Patent Number: 5,507,892

[45] Date of Patent: Apr. 16, 1996

[54] EXPLOSIVE COMPOSITION SUITABLE FOR CARTRIDGING IN PAPER AND ITS METHOD OF MANUFACTURE

[75] Inventors: Juan A. A. Zabala, Bilbao; Fernando B. G. De Segura, Vitoria; Agustin G. Ocejo, Bilbao, all of Spain; Leon M. Zimmermann; Marie V. M. Hall, both of Johannesburg, South Africa

[73] Assignee: Union Espanola de Explosivos, Sociedad Anonima, Madrid, Spain

[21] Appl. No.: 230,163

[22] Filed: Apr. 19, 1994

[30] Foreign Application Priority Data

Apr. 20, 1993 [ES] Spain ..... 9300829

[51] Int. Cl.[6] ..... C06B 31/30

[52] U.S. Cl. ..... 149/60; 149/46; 149/109.6

[58] Field of Search ..... 149/46, 60, 196

[56] References Cited

U.S. PATENT DOCUMENTS

| | | | |
|---|---|---|---|
| 3,049,453 | 8/1962 | DeWilde | 149/20 |
| 4,033,264 | 7/1977 | Bolza et al. | 102/24 |
| 4,096,003 | 6/1978 | Machacek | 149/2 |
| 4,420,440 | 12/1983 | Marz | 264/3 |
| 4,756,776 | 7/1988 | Halliday et al. | 149/2 |

FOREIGN PATENT DOCUMENTS

| | | | |
|---|---|---|---|
| 0187709 | 7/1986 | European Pat. Off. | F42B 3/00 |
| 2005367 | 3/1989 | Spain | B65B 11/02 |
| 0648816 | 4/1985 | Switzerland | C06B 25/00 |
| 1216229 | 12/1970 | United Kingdom | C06B 1/04 |

*Primary Examiner*—Donald P. Walsh
*Assistant Examiner*—Anthony R. Chi
*Attorney, Agent, or Firm*—Ladas & Parry

[57] ABSTRACT

A watergel explosive composition is provided which contains an oxidiser salt, a sensitiser, a thickener, a crosslinking agent, a fuel and water, the sensitiser component including more than 50% by weight of one or more water soluble compounds selected particularly from monomethylamine nitrate, ethanolamine nitrate, diethanolamine nitrate, triethanolamine nitrate, dimethylamine nitrate, hexamine nitrate, ethylenediamine dinitrate, laurylamine nitrate or mixtures of these. The composition contains less than 10% by water and has a rheology and hygroscopicity which makes its cartridging in paper cartridges possible on standard machines. A method of producing the explosive compositions as well as explosive cartridges containing them are also described.

22 Claims, No Drawings

EXPLOSIVE COMPOSITION SUITABLE FOR CARTRIDGING IN PAPER AND ITS METHOD OF MANUFACTURE

FIELD OF THE INVENTION

The present invention refers to an explosive composition of the type known as a watergel and to a process for manufacturing this explosive composition. This composition is formulated with a low water content and the process used for its manufacture yields a product with a rheology and hygroscopicity which makes its cartridging in paper cartridges possible on existing machines.

BACKGROUND OF THE INVENTION

Watergel explosives, also known as slurry explosives, are widely used in many applications. They perform well and offer advantages over conventional nitroglycerine-based explosives in terms of improved safety in manufacture, use and storage.

In essence a watergel explosive consists of a fluid mixture of oxidiser salts, fuels, thickeners, sensitisers and crosslinking agents. Normally, watergel explosives are two phase systems (which can be prepared as a single phase), and contain between 10% and 30% water. Thus, a portion of the oxidiser salts and occasionally the sensitiser are dissolved in the water and the balance are dispersed in the solution. To improve the dispersion capacity of the solids in the solution, thickeners that raise the viscosity of the system are added, thus ensuring a greater homogeneity of the final product.

Because of the high water content, the product initially has a fluid consistency that allows easy pouring Of it directly into the blast holes. However, as long as the product remains fluid it is not possible to pack it in the standard paper cartridges used, for example, for packaging nitroglycerine-based explosives as the watergel wets the paper and it disintegrates. The consistency of a watergel thus necessitates cartridging of the product in hermetically sealed plastics containers, generally of high or low density polyethylene. Watergels cartridged in plastic do not load well into boreholes because the plastic packaging resists breaking thereby preventing the explosive from filling the boreholes properly. Also, the plastics packaging itself is not suitable for use in many mines, for example asbestos mines and diamond mines.

The gelatinous and powder explosives sensitised with nitroglycerine, nitroglycol or other nitrates of alcohols or mixtures thereof, have the advantage that they can be easily cartridged in paper. However, the use of these explosives presents problems for the user, on the one hand because these sensitisers are vasodilators and they cause headaches and other circulatory problems, and on the other hand because the detonation fumes contain a high percentage of toxic gasses such as oxides of nitrogen and carbon monoxide.

In European patent EP 0187709 an attempt is made to overcome the problems associated with the packaging of watergel compositions by providing a paper-based cartridge that has at least one of its surfaces coated with a resin, which is resistant to water-based explosives. The patent describes the production of a waterproof paper cartridge, which is simply made of plastic-faced paper and it is made on a special machine constructed for this purpose. The explosive packaged in the cartridge is, however, a standard watergel or emulsion explosive. The resistance of the package to wetting by the watergel is entirely dependent on the integrity of the plastic layer in contact with the water gel within the package. In the patents ES 2005367, U.S. Pat. No. 4420440 and U.S. Pat. No. 4756776 procedures or methods, machines or apparatus are claimed for cartridging explosive formulations without claiming the specific products to be made and to be cartridged according to the procedures described in them.

To give watergels a better consistency and water resistance, thereby avoiding the leaching of the salts by external water and a resultant loss of explosive performance, the gel is crosslinked. In this form the product takes on an elastic consistency after a certain time that is impossible to shape and manipulate for cartridging, which is why the packaging is done while the material is still fluid. The crosslinked product, however, still wets the paper, making this an unsuitable packaging material for watergels of the prior art.

Generally, in explosive compositions sensitised with monomethylamine nitrate or other alkylamine or alkanolamine nitrates, the quantity of sensitiser is much greater than 15%, and frequently greater than 20%. In U.S. Pat. No. 4,096,003 a method is proposed to produce a watergel using only 8% monomethylamine or monoethanolamine nitrate as well as utilising a well known sensitiser for watergels, namely pigment aluminium, as a supplementary sensitiser. (Pigment aluminium is finally divided aluminium, often in the form of flat flakes, which is used as a sensitiser in watergel compositions. It typically has a surface area in excess of 5000 $cm^2/g$.) However, the watergels described in U.S. Pat. No. 4,096,003 all contain greater than 10%, by mass, of water.

SUMMARY OF THE INVENTION

According to the invention a watergel explosive composition contains an oxidiser salt; a sensitiser; a thickener; a crosslinking agent; a fuel; and water, the sensitiser component including more than 50% by weight of one or more water soluble compounds of oxygen balance more positive than −150%, selected from salts of nitric, chloric and perchloric acid with acylic nitrogen bases, having no more than two hydrogen atoms bonded to each basic nitrogen atom and up to three carbon atoms per basic nitrogen atom, and the salts of nitric, chloric, and perchloric acid with a phenyl amine, and the water content being less than 10%, by mass, of the composition.

The water soluble sensitiser may be an alkylamine nitrate or an alkanolamine nitrate. Preferred examples are monomethylamine nitrate, ethanolamine nitrate, diethanolamine nitrate, triethanolamine nitrate, dimethylamine nitrate, hexamine nitrate, ethylenediamine dinitrate, laurylamine nitrate and mixtures of these.

Preferably, the watergel explosive composition contains monomethylamine nitrate in an amount of less than 14%, by mass, of the composition.

The watergel explosive composition may contain a second, different sensitiser. The second sensitiser may be water insoluble and may be pigment aluminium.

The oxidiser salt is preferably a nitrate or perchlorate of ammonia or of an alkali or alkaline earth metal, or mixtures of these.

The watergel explosive composition may also contain a halide or carbonate of an alkali or alkaline earth metal, typically sodium or potassium or calcium, talc or a salt pair consisting of ammonium halide and sodium or potassium nitrate. The inclusion of these constituents makes the watergel explosive composition particularly suitable for use in coal mines as it may then be made to comply with the tests prescribed by the various national regulatory authorities.

The fuel may be a product of vegetable origin, such as a starch, for example flour, sawdust, rubber, coal or sugar, or a vegetable oil. Alternatively, it may be a product derived from crude oil or organic fuel. Preferred examples of organic fuels are hydrocarbons, glycol waxes and rubber. Further alternatively, it may be metallic fuel, such as aluminium.

The thickener may be a product derived from a seed, such as guar gum or a galactomannan. Alternatively, it may be a biosynthetic product such as xanthan gum, starch and its derivatives, such as carboxymethyl cellulose. Further alternatively, it may be a synthetic polymer, such as polyacrylamide.

The watergel explosive composition may also contain a density reducing agent, which may be a solid void-containing material, such as perlite, glass microspheres or plastic microspheres or expanded polystyrene, or a chemical additive which is capable of generating gas in situ.

According to another aspect of the invention a process for manufacturing a watergel explosive composition of the invention comprises the steps of:

preparing a thickened aqueous phase comprising a thickened, aqueous solution of at least some of the water soluble sensitiser, thickener and optionally a portion of the oxidiser salt;

preparing a dry phase comprising the, or any remaining, oxidiser salt, thickener, crosslinking agent, fuel, any water insoluble sensitiser, and any remaining water soluble sensitiser, separately;

mixing the two phases; and reducing the density of the mixture by mixing the composition in such a way so as to incorporate gas into it or by adding a density reducing agent.

According to yet another aspect of the invention a process for manufacturing a watergel explosive composition of the invention comprises the steps of mixing together the oxidiser salt, any water insoluble sensitiser, thickener, crosslinking agent, fuel and adding the water soluble sensitiser in aqueous solution and mixing until a paste is formed.

According to yet another aspect of the invention an explosive cartridge comprises a paper cartridge and a watergel explosive composition of the invention contained within the paper cartridge.

According to yet another aspect of the invention a method of cartridging a watergel explosive composition comprises the step of filling a paper cartridge with a watergel explosive composition of the invention using a cartridging machine of the type used to cartridge nitroglycerine-sensitised explosives.

Paper in the specification being defined as any cellulosic material which is substantially free of any plastics material.

DETAILED DESCRIPTION OF THE INVENTION

The present invention provides watergel explosive compositions capable of initiation by a number 6 strength detonator in small diameter cartridges (including those below 26mm) and which can be cartridged in paper cartridges. It also provides a process for manufacturing them.

The watergel explosive compositions have a low water content which results, on the one hand in a product with improved explosive performance, and on the other hand in a product with very little stickiness and which has a plastic rheology and very little tendency to release water, which allows the resulting paste to be formed into cylindrical shapes, as well as allowing it to be packaged on machines commonly used for cartridging in paper. Thus, besides having the performance properties of watergels further enhanced because of a lower water content, the present compositions can be cartridged in paper on standard cartridging machines of the type used for packaging reactive explosive compositions sensitised with nitroglycerine, such as ROLLEX® machines, which are designed with safety in mind.

The water content of the explosive composition must be below 10%. One can obtain pastes with a rheology which is excellent for cartridging in paper with a water content of as low as 3%. It is known that water in watergel explosive compositions acts as an energy sink and should be kept to a minimum. However, generally watergels previously known in the art with a water content of lower than 8% and little or no insoluble explosive sensitiser have not proved to be cap sensitive in small diameter. It was thus unexpected that the explosive compositions of the present invention with a radically reduced amount of water, below 5% by mass of the composition, would be effective. However, this very low water content produced a watergel of the correct consistency to enable it to be packaged in paper cartridges without wetting them and which was not sticky, a factor which would lead quickly to the gumming up of a cartridging machine, and without any need to modify the standard machine in any way. The utilisation of substantially more than 5% by mass of water, for example 6%, rendered the resulting watergel too sticky to be packaged in standard waxed paper using a standard paper cartridge packaging machine.

The cartridging of watergel explosive compositions using such machines is very safe as opposed to cartridging using conventional form/fill/clip watergel cartridging machines, such as the KARTRIDGPAK® machine, in which there is a lot of metal to metal contact and which are therefore inherently less safe. Plant safety is thus enhanced by the invention by the combination of utilising a safe explosive composition, namely a watergel, and a safe packaging or cartridging process, namely the paper cartridging process.

The paper-packaged, explosive watergels of the composition are, however, notably easier to charge than plastics-packaged watergels in horizontal and updipping holes, conditions frequently encountered in underground mines. This ease of loading is due to the plastic nature of the explosive. This results in the product, on being tamped, taking on the shape of the borehole. This characteristic improves the coupling ratio in the blasthole and makes it less likely that the explosive will accidentally fall out of the hole.

A first process of the invention consists of:

(i) the separate preparation of:

a) a thickened aqueous solution of high viscosity—the so-called thickened phase; and b) a mixture with a powdery texture of oxidiser salts with liquid or solid fuels—the so-called dry phase, and (ii) the mixing of the two phases to yield a paste with a low water content and a plastic texture which allows the mixture to cartridged in paper.

The thickened phase is prepared in a vessel equipped with an agitator and heating means, and is prepared from a concentrated aqueous solution of at least some of the water soluble sensitiser, either on its own or with some of the oxidiser salts, and thickened with at least some of the thickener. This solution can be held at a temperature between 20° C. and 85° C., depending on the crystallisation temperature of the solution. This generally varies between 30° C. and 60° C. By means of agitation a perfect solution of the salts is achieved as well as hydration and dissolution of the thickeners resulting in a gel with a viscosity of between 5 and 150 Pa.s.

The dry phase is prepared in a mixer, generally at ambient temperature, and consists of a mixture of the, or any remaining, oxidiser salts, either on their own or with a solution of the rest of the water soluble sensitiser/s absorbed onto them, the remainder of the thickener, the crosslinking agent, fuels, which may be solid or liquid and any water insoluble sensitiser. Any liquid component added to the dry phase becomes adsorbed onto the oxidiser salts and thus this phase remains dry. The thickened aqueous phase and the dry phase are then mixed in a mixer, generally at ambient temperature.

A density reducing material in the form of a solid void-containing material may be added to the mixture. Alternatively, an in situ gas generating chemical, for example sodium nitrite, may be added to the mixture or gas may simply be incorporated mechanically into the mixture by the mixing process, resulting in a paste with a density of between 0.9 and 1.3 g/cc, which is cap sensitive and which can be formed and cartridged into paper.

A second process of the invention, which also results in a paste with the above characteristics involves making the mixture in a single vessel of the kneading type by first mixing the solid components, then adding the water soluble sensitisers in water and mixing until a paste is achieved with the desired appearance.

The oxidiser salts are those normally used in watergel explosives technology. These include nitrates or perchlorates of ammonia and the alkali metals and the alkaline earth metals. Specifically, these salts may be ammonium nitrate or perchlorate, sodium nitrate or perchlorate, potassium nitrate or perchlorate, lithium nitrate or perchlorate, magnesium nitrate or perchlorate, calcium nitrate or perchlorate, and also mixtures of these. The total concentration of oxidiser salts varies between 30% and 90% of the total mass of the watergel, preferably between 40% and 75%.

The water soluble sensitiser is any water soluble nitrate of alkylamine or alkanolamine, such as monomethylamine nitrate, ethanolamine nitrate, diethanolamine nitrate, triethanolamine nitrate, dimethylamine nitrate, as well as nitrates of other water soluble amines such as hexamine, diethylenetriamine, ethylenediamine, laurylamine and mixtures of these. The total concentration of water soluble sensitisers can vary between 1% and 40% of the weight of the formulation. Preferably between 2% and 30%.

Although the explosive compositions of the invention are sensitive without any supplementary sensitiser having to be added, as shown in the examples, a small amount, typically below 6%, of a second, supplementary sensitiser may be added to give the composition extra energy and extra sensitivity, particularly at very low temperatures. This is in contrast to other water-containing compositions such as that described in U.S. Pat. No. 882,555 to de Wilde, where a substantial amount of a supplementary explosive composition is required to achieve sensitivity at all. Such supplementary sensitisers must be insoluble in water and include pigment aluminium and/or supplementary explosives such as TNT, PETN etc.

The supplementary sensitisers and/or explosives are incorporated into the dry phase of the formulation. The concentration of aluminium can vary between 0.1% and 10%, although it is preferable to use between 1% and 5%. In general the total concentration of insoluble sensitisers varies between 1% and 25%, preferably between 1% and 20%. It should be pointed out that the addition of these supplementary sensitisers and explosives reduces the safety during manufacture of the compositions of the invention and that with the present invention an effective watergel which is cap sensitive in 26mm diameter cartridges can be prepared using only monomethylamine nitrate as the sensitiser at a concentration as low as, or even below, 14% without the need to use additional sensitisers.

The thickeners are products derived from seeds, such as guar gum, galactomannins, or biosynthetic products, such as xanthan gum, starch and its derivatives, such as carboxymethylcelulose, or synthetic polymers, such as polyacrylamide. The concentration of thickener can vary between 0.1 and 5%, preferably between 0.5% and 2%. Optionally, and to give the product a better consistency and water resistance, the composition can be crosslinked utilising crosslinking agents suitable for each type of thickener. Among these are compounds of antimony, such as potassium pyroantimonate; chromium, such as chromic acid, potassium dichromate or potassium chromate for guar gums; titanium compounds, such as titanium lactate; and aluminium compounds, such as aluminium sulphate for polyacrylamide. The concentration of the crosslinking agents may vary between 0.01% and 5%, and preferably between 0.01 and 2%.

One type of density reducing agent is a solid void-containing material. Examples of such density reducing agents are perlite, glass or plastic microspheres or expanded polystyrene. Another type of density reducing agent is one which causes the formation of small gas bubbles as a result of a chemical reaction, such as sodium nitrite. If a solid density reducing agent is used, the total concentration there can vary between 0.1% and 3%, preferably between 0.5% and 2%. As mentioned above, by mechanical entrainment during the mixing of the thickened aqueous phase and the dry phase, air, or other gas bubbles, can be included in the paste without the need to add a density reducing agent. This can be achieved by mechanical kneading and here one might use a substituted guar gum, such as hydroxypropyl guar, as the thickener which will assist in the entrainment of the gas.

The fuels of vegetable origin comprise starches, flours, sawdust, rubber, coal, sugars, oils. Those derived from crude oil comprise organic fuels such as hydrocarbons, glycol, waxes and rubber, and a preferred metallic fuel is aluminium. In general, the total concentration of fuel varies between 3% and 20%, preferably between 3% and 7%.

The explosive composition can also contain a flame retarding agent, such as a halide of an alkali or alkaline earth metals, such as sodium and potassium chloride, or carbonates of the previously mentioned elements, talc or a salt pair consisting of ammonium halide and sodium or potassium nitrate, for use as permitted (or permissible) explosives. The concentration of flame retardant can vary between 5% and 35%, preferably between 10% and 30%.

The following are illustrative examples of compositions prepared according to the two different processes of manufacture of the invention. In no way do they restrict the character of the invention. Many other compositions which meet the requirements of sensitivity and paper cartridgeability of this invention can be prepared.

EXAMPLE 1

In a mixer controlled at 60° C. we introduced 14 parts of an 80% solution of monomethylamine nitrate, after which we added 9 parts of ammonium nitrate with agitation until a clear solution was obtained. After which we slowly added a mixture of 5 parts of sodium perchlorate with 0.6 parts of guar gum. The mixture was vigorously agitated for two minutes. After this time we had a thickened solution with a viscosity of 57 Pa.s.

At the same time we introduced 59.5 parts of ammonium nitrate into a horizontal mixer, after which we added 6 parts of 80% monomethylamine nitrate solution heated to 80° C., mixing was continued until the mixture took on a dry appearance. After this we added 2.8 parts of saw dust, 1 part of guar gum, 0.1 parts of adipic acid and 0,016 parts of potassium pyroantimonate, mixing was continued until the mixture appeared homogeneous. Finally 2 parts of glass microspheres were added followed by the second phase previously prepared. After two minutes of mixing we had a paste with an appearance suitable for cartridging in paper in a cartridging machine of the type used for the cartridging of explosives sensitised with nitroglycerine.

The resulting paste had a total water content of 4% and was cartridged in paper cartridges of 26mm diameter and 32mm diameter, resulting in products with densities in the range 1.14 to 1.18 g/cm. A number of cartridges were tested, unconfined, with a number 6 strength detonator in order to determine the critical temperature for each diameter. This proved to be −5° C. and 0° C. for 32mm diameter and 26mm diameter cartridges respectively. Similarly we determined the velocity of detonation of both diameter cartridges at 5° C. Here the results were 2855 m/s for the 26mm cartridge and 324 1 m/s for the 32mm cartridge.

EXAMPLE 2

Into a mixer we placed 65.7 parts of ammonium nitrate, 10 parts of sodium nitrate, 3.4 parts of flour and 1.6 parts of guar gum and mixed them until they were homogeneous. In another receptacle we prepared a mixture of 19 parts of 80% monomethylamine nitrate solution and 0.1 parts of thiourea. These were heated to 80° C. and added to the previous mixture. Mixing was continued until it resulted in a well mixed paste. At this point 0.2 parts of a 15% sodium nitrite solution was added, followed by 0.16 parts of potassium pyroantimonate. The resulting paste had a similar rheology to the previous example, allowing the product to be cartridged in paper.

When test fired in 26mm and 32mm diameter cartridges at 20° C. and initiated with a No. 6 strength detonator, we obtained velocity readings of 1984 and 2841 m/s respectively.

EXAMPLE 3

In this example a thickened solution was prepared from monomethylamine nitrate solution only and the dry phase had no soluble sensitiser added to it.

To a heated mixer we added 22 parts of an 80% monomethylamine nitrate solution and 0.12 parts of thiourea. This mixture was heated to 65° C.

0.4 parts of guar gum were slurried with 1 part of glycol and added to the rapidly stirred monomethylamine nitrate solution and mixed for one minute to obtain a good viscosity.

67.3 parts of ammonium nitrate, 6 parts of potassium perchlorate, 2.3 parts of ground rubber, one part of guar gum, 0.1 part of adipic acid and 0.014 parts of potassium pyroantimonate were mixed together in another mixer until the mixture was homogeneous. Once the dry mixture was homogeneous, the viscous monomethylamine nitrate solution mentioned above was added to the dry mixture and mixing was continued. Once the mixture was cohesive, 0.2 parts of a 15% sodium nitrite solution was added to this and mixed until the sodium nitrite solution was incorporated into the paste.

The paste had a density of 1.22 g/cm$^3$ and was easily packed into paper cartridges.

Cartridges of 25mm diameter were cap sensitive at 5° C. to a number 6 strength detonator.

EXAMPLE 4

A composition as described in Example 3 above was prepared using 69.5 parts of ammonium nitrate, and 4 parts of pigment aluminium instead of 6 parts of potassium perchlorate. A suitable paste was obtained.

We claim:

1. A cap sensitive watergel explosive composition containing an oxidiser salt; a sensitiser; a thickener; a crosslinking agent; a fuel; and water, a sensitiser component including more than 50% by weight of one or more water soluble compounds of oxygen balance more positive than −150% selected from salts of nitric, chloric and perchloric acid with acyclic nitrogen bases, having no more than two hydrogen atoms bonded to each basic nitrogen atom and up to three carbon atoms per basic nitrogen atom, and the salts of nitric, chloric, and perchloric acid with a phenyl amine, and the water content being less than 8%, by mass, of the composition.

2. A watergel explosive composition according to claim 1 which has a water content of below 5%, by mass, of the composition.

3. A watergel explosive composition according to claim 1 wherein the water soluble sensitiser comprises an alkylamine nitrate or alkanolamine nitrate.

4. A watergel explosive composition according to claim 3 wherein the sensitiser is monomethylamine nitrate, ethanolamine nitrate, diethanolamine nitrate, triethanolamine nitrate, dimethylamine nitrate, hexamine nitrate, ethylenediamine nitrate, laurylamine nitrate or mixtures of these.

5. A watergel explosive composition according to claim 4 wherein the sensitiser is monomethylamine nitrate.

6. A watergel explosive composition according to claim 5 which contains less than 14%, by mass, of the composition of monomethylamine nitrate.

7. A watergel explosive composition according to claim 1 which contains a second different sensitiser which is water insoluble.

8. A watergel explosive composition according to claim 7 wherein the second sensitiser is pigment aluminium.

9. A watergel explosive composition according to claim 1 wherein the oxidiser salt is a nitrate or perchlorate of ammonia or of an alkali or alkaline earth metal, or mixtures thereof.

10. A watergel explosive composition according to claim 1 which contains a halide or a carbonate of an alkali or alkaline earth metal, talc or an ammonium halide and a sodium or potassium nitrate salt pair.

11. A watergel explosive composition according to claim 10 which contains a sodium or potassium or calcium halide or calcium carbonate.

12. A watergel explosive composition according to claim 1 wherein the fuel is a product of vegetable origin, a product derived from crude oil or organic fuel or a metallic product.

13. A watergel explosive composition according to claim 12 wherein the fuel is a product of vegetable origin and comprises starch, sawdust, rubber, coal, sugar or a vegetable oil.

14. A watergel explosive composition according to claim 12 wherein the fuel is an organic fuel and comprises a hydrocarbon, glycol wax or rubber.

15. A watergel explosive composition according to claim 12 wherein the fuel is a metallic fuel and comprises aluminium.

16. A watergel explosive composition according to claim 1 wherein the thickener is a product derived from a seed, or a biosynthetic product or a synthetic polymer.

17. A watergel explosive composition according to claim 1 which contains a density reducing agent which causes the incorporation within the composition of small gas bubbles.

18. A watergel explosive composition according to claim 17 wherein the density reducing agent is a solid void-containing material or a chemical additive which is capable of generating gas within the composition.

19. A watergel explosive composition according to claim 18 wherein the density reducing agent is a solid void-containing material selected from perlite, glass or plastic microspheres and expanded polystyrene.

20. A process for manufacturing a cap sensitive watergel explosive composition containing an oxidiser salt: a sensitiser; a thickener: a crosslinking agent; a fuel; and water, the sensitiser component including more than 50% by weight of one or more water soluble compounds of oxygen balance more positive than −150%, selected from salts of nitric, chloric and perchloric acid with ayclic nitrogen bases, having no more than two hydrogen atoms bonded to each basic nitrogen atom and up to three carbon atoms per basic nitrogen atom, and the salts of nitric, chloric, and perchloric acid with a phenyl amine, comprising the steps of:

preparing a thickened aqueous phase comprising a thickened, aqueous solution of at least some of the water soluble sensitiser, thickener and a portion of the oxidiser salt;

preparing a dry phase comprising any remaining oxidiser salt, any remaining thickener, crosslinking agent, fuel, any water insoluble sensitiser, and any remaining water soluble sensitiser, separately; mixing the two phases; and reducing the density of the mixture by mixing the composition in such a way so as to incorporate gas into it or by adding a density reducing agent.

21. An explosive cartridge comprising a paper cartridge and a watergel explosive composition according to claim 1 within the paper cartridge.

22. A method of cartridging a watergel explosive composition comprising the step of filling a paper cartridge with a watergel explosive composition according to claim 1 using a cartridging machine of the type used to cartridge nitroglycerine-sensitised explosives.

* * * * *

UNITED STATES PATENT AND TRADEMARK OFFICE

CERTIFICATE OF CORRECTION

PATENT NO. : 5,507,892

DATED : April 16, 1996

INVENTOR(S) : Juan A.A. Zabala et al.

It is certified that error appears in the above—identified patent and that said Letters Patent is hereby corrected as shown below:

claim 20, line 7, delete "ayclic" and insert " acyclic".

Signed and Sealed this

First Day of October, 1996

Bruce Lehman

*Attest:*

BRUCE LEHMAN

*Attesting Officer*

*Commissioner of Patents and Trademarks*